US008388774B1

(12) United States Patent
Watson

(10) Patent No.: US 8,388,774 B1
(45) **Date of Patent: *Mar. 5, 2013**

(54) MULTIWAVE THERMAL PROCESSES TO IMPROVE METALLURGICAL CHARACTERISTICS

(76) Inventor: Daniel Martin Watson, Driftwood, TX (US)

( * ) Notice: Subject to any disclaimer, the term of this patent is extended or adjusted under 35 U.S.C. 154(b) by 358 days.

This patent is subject to a terminal disclaimer.

(21) Appl. No.: 12/843,733

(22) Filed: Jul. 26, 2010

Related U.S. Application Data

(63) Continuation-in-part of application No. 11/869,572, filed on Oct. 9, 2007, now Pat. No. 7,763,130, which is a continuation-in-part of application No. 10/783,934, filed on Feb. 20, 2004, now Pat. No. 7,297,418.

(60) Provisional application No. 60/482,030, filed on Jun. 24, 2003.

(51) Int. Cl.
*C21D 9/00* (2006.01)

(52) U.S. Cl. ..... 148/577; 148/578

(58) Field of Classification Search ..... 148/577, 148/578

See application file for complete search history.

(56) References Cited

U.S. PATENT DOCUMENTS

| | | | |
|---|---|---|---|
| 4,448,613 | A | 5/1984 | Sherby et al. |
| 4,739,622 | A | 4/1988 | Smith |
| 4,769,214 | A | 9/1988 | Sherby et al. |
| 5,031,063 | A | 7/1991 | Hasegawa |
| 5,103,701 | A | 4/1992 | Lundin et al. |
| 5,181,970 | A | 1/1993 | Ueda et al. |
| 5,259,200 | A | 11/1993 | Kamody |
| 5,263,886 | A | 11/1993 | Workman |
| 5,445,685 | A | 8/1995 | Strum et al. |
| 5,447,035 | A | 9/1995 | Workman et al. |
| 5,512,235 | A | 4/1996 | Cerutti et al. |
| 5,865,913 | A | 2/1999 | Paulin et al. |
| 6,030,596 | A | 2/2000 | Vilella Jirau |
| 6,141,974 | A | 11/2000 | Waldmann et al. |
| 6,164,079 | A | 12/2000 | Waldmann et al. |
| 6,314,743 | B1 | 11/2001 | Hutchison |
| 6,319,460 | B1 | 11/2001 | Fang |

(Continued)

FOREIGN PATENT DOCUMENTS

| | | |
|---|---|---|
| JP | 56133445 | 10/1981 |
| JP | 09-137247 | 5/1997 |

(Continued)

OTHER PUBLICATIONS

Verhoeven, John D., A Review of Microsegregation Induced Banding Phenomena in Steels, Journal of Materials Engineering and Performance, vol. 9(3) Jun. 2000, pp. 286-296.

(Continued)

*Primary Examiner* — Jie Yang
(74) *Attorney, Agent, or Firm* — Buskop Law Group, PC; Wendy Buskop

(57) ABSTRACT

A multi-wave thermal process for treating a metal to improve structural characteristics is herein disclosed. The metal can be placed in a chamber. Each wave of the process can include: selecting a target temperature; selecting a temperature rate; and controlling the temperature rate while chilling the metal by introducing a cryogenic material into the chamber, while preventing over-stressing of the metal, to the target temperature at the temperature rate. While chilling the metal, the process can include inserting a hold time on the metal at an intermediate temperature for equalization of the temperature uniformly throughout the metal, thereby creating uniformity in a microcrystalline structure of the metal. The process can further include: stopping the introduction of the cryogenic material once the target temperature is reached and holding the metal at the target temperature. The process can result in a treated metal without fractures and with an organized microcrystalline structure.

18 Claims, 7 Drawing Sheets

U.S. PATENT DOCUMENTS

| | | | | |
|---|---|---|---|---|
| 6,395,108 | B2 | 5/2002 | Eberle et al. | |
| 6,487,938 | B1 | 12/2002 | Koegler | |
| 6,506,270 | B2 | 1/2003 | Takashina et al. | |
| 6,537,396 | B1 | 3/2003 | Ijames | |
| 6,544,669 | B2 | 4/2003 | Groll | |
| 6,609,963 | B2 | 8/2003 | Li et al. | |
| 6,655,234 | B2 | 12/2003 | Scott | |
| 7,163,595 | B2 * | 1/2007 | Watson | 148/577 |
| 7,297,418 | B2 | 11/2007 | Watson | |
| 7,459,038 | B1 | 12/2008 | Watson | |
| 7,459,039 | B1 | 12/2008 | Watson | |
| 7,459,040 | B1 | 12/2008 | Watson | |
| 7,763,130 | B2 * | 7/2010 | Watson et al. | 148/578 |
| 2002/0179204 | A1 | 12/2002 | Brunson | |

FOREIGN PATENT DOCUMENTS

| | | | |
|---|---|---|---|
| JP | 2000-273537 | | 10/2000 |
| SU | 956894 | A | 9/1982 |

OTHER PUBLICATIONS

Sword Forum International, found at http://forums.swordforum.com/showthread.php?t=11162, as of Dec. 20, 2007.

Bryson, William E., Cryogenics, 1999, Hanser Gardner Publications, pp. 29, 40, 49-52, 65-75.

Weisend II, J. G., Handbook of Cryogenic Engineering, May 6, 1999, Taylor & Francis, 413-428.

Earl A. Carlson, Cold Treating and Cryogenic Treatment of Steel, ASM Handbook, vol. 4, pp. 203-206, Mar. 2001.

* cited by examiner

MULTIWAVE THERMAL PROCESSES TO IMPROVE METALLURGICAL CHARACTERISTICS

CROSS-REFERENCE TO RELATED APPLICATIONS

The present application is a continuation in part of U.S. patent application Ser. No. 11/869,572 filed on Oct. 9, 2007, which is projected to issue as U.S. Pat. No. 7,763,130 on Jul. 27, 2010, which is a continuation in part of U.S. patent application Ser. No. 10/783,934 filed on Feb. 20, 2004, and now issued as U.S. Pat. No. 7,297,418, which further claims priority to U.S. Provisional Patent Application Ser. No. 60/482,030 filed on Jun. 24, 2003. The entirety of these references are herein incorporated.

FIELD

The present embodiments generally relate to thermal processes for treating metal to improve the structural characteristics of the metal.

BACKGROUND

A need exists for a process to treat metal and similar materials of manufacture to increase the structural characteristics of the metal and similar materials. For example, when manufacturing tools, tool components, machinery, engine parts, wear surfaces, and like articles made from various steels and materials used for high wear applications, the common practice is to subject the steel to one or more thermal process treatments. This is performed either before or after formation of the steel, so as to modify the properties of at least the exterior of the components. These treatments can provide the articles with greater strength, enhanced conductivity, greater toughness, enhanced flexibility, longer wear life, and other similar benefits.

A number of thermal type processes are known in the metallurgical arts to enhance the properties of manufacturing materials, such as steels and the like. One widely used class of such metallurgical processes generally known as quenching typically involves forming an article of the desired metal containing material and then rapidly lowering the temperature of the article, followed by a return of the article to ambient temperature. The problem with the current processes, controlled or not, is the formation of residual stress in the material. This results in stressing the material and even possibly fracturing the material, rendering it useless.

A further enhancement process for manufacturing materials, such as steel, involves the formation of a nitride containing layer on the surface of an article of the metal containing material that hardens the material by forming nitrides such as metal nitrides at or near the surface of an article. The formed nitride surface layer can include extremely hard compounds containing nitrides such as CrN, $Fe_2N$, $Fe_3N$, and $Fe_4N$. The formed nitride layer tends to create compressive stresses that can lead to distortions in the article being treated.

A need exists for a thermal process that can be modified depending upon the specific material being treated and that does not create secondary stresses commonly associated with cryogenic and thermal temperature changes. The current art describes single wave processes that concentrate on the cryogenic target temperature and possibly one positive range temperature. The focus of the current art on the cryogenic target temperature does not give any regard to the material being treated. The cryogenic phase causes stresses in the metal, and the subsequent heat process also causes stresses in the material. The prior art has done little to deal with these secondary stresses.

A need exists for multi-wave thermal treatments in which the target temperatures are dictated by the material being treated.

A need has long existed for a thermal process to treat a metal or article of manufacture to improve its structural characteristics.

The present embodiments meet these needs.

BRIEF DESCRIPTION OF THE DRAWINGS

The present embodiments will be explained in greater detail with reference to the appended Figures, in which.

Figure 1:
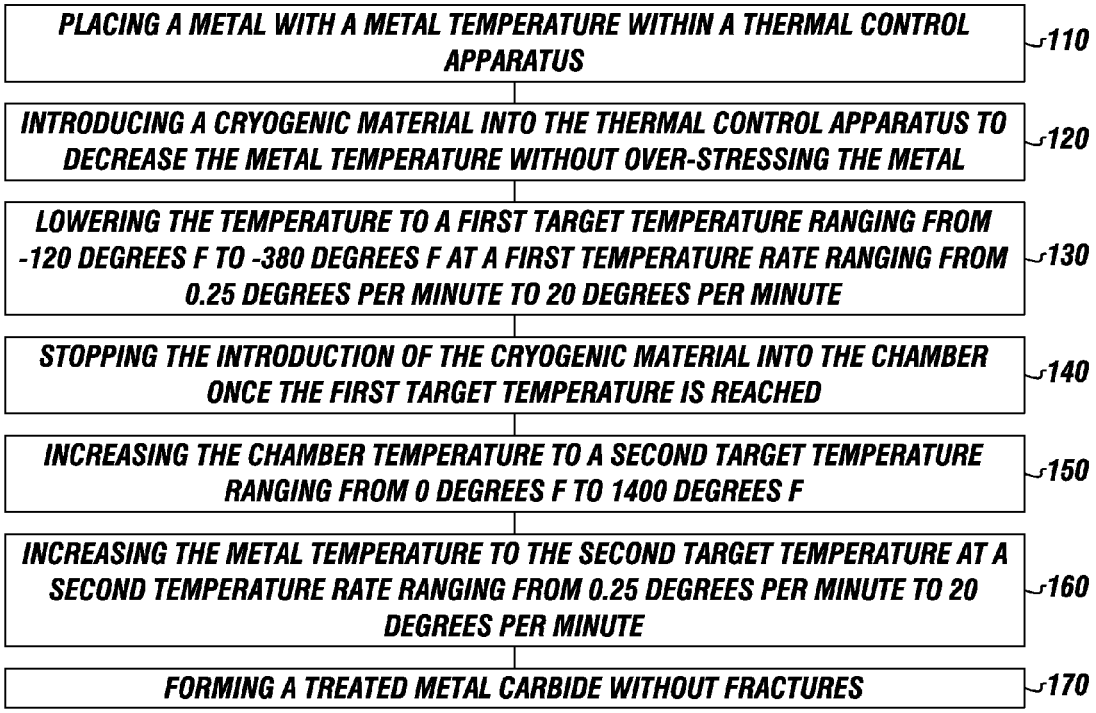
FIG. 1 is a schematic diagram of the steps of an embodiment of the present method.

The present embodiments are detailed below with reference to the listed Figures.

DETAILED DESCRIPTION OF THE PREFERRED EMBODIMENTS

Before explaining the present process in detail, it is to be understood that the process is not limited to the particular embodiments herein and that the process can be practiced or carried out in various ways.

The present embodiments relate to a thermal process for treating a metal.

One or more embodiments relate to a multi-wave thermal process for treating a metal to improve at least one structural characteristic of the metal.

The process can include placing the metal with a metal temperature within a thermal control apparatus having a chamber with a chamber temperature.

The process can include selecting a first target temperature based on the metal. The first target temperature can range from about −120 degrees Fahrenheit to about −380 degrees Fahrenheit.

The process can include selecting a first temperature rate based on the metal, a size of the metal, a mass of the metal or combinations thereof. The first temperature rate can range from about 0.25 degrees Fahrenheit per minute to about 20 degrees Fahrenheit per minute.

The process cam include controlling the first temperature rate while cryogenically chilling the metal by introducing a first cryogenic material into the thermal control apparatus to decrease the metal temperature, while preventing over-stressing of the metal, to the first target temperature at the first temperature rate.

The process can include inserting at least one stabilizing hold time on the metal during cooling or cryogenically chilling the metal to the first target temperature. The stabilizing hold time can be from about thirty seconds to about ninety minutes. The stabilizing hold time can be inserted at a first intermediate temperature for equalization of the metal temperature uniformly throughout the metal, thereby creating uniformity in the microcrystalline structure of the metal. The stabilizing hold time can correspond to the size of the metal, the metal temperature, and the thermal conductivity of the metal. For example, with a first target temperature of −200 degrees Fahrenheit, a stabilizing hold time can be inserted into the thermal process during the chilling of the metal to −200 degrees Fahrenheit. In this example, the first intermediate temperature can be −150 degrees Fahrenheit. The chilling of the metal can be stopped at the first intermediate temperature for a time ranging from about thirty seconds to about ninety minutes. The chilling of the metal to the target temperature of −200 degrees Fahrenheit can then be resumed.

The process can include stopping the introduction of the first cryogenic material into the chamber once the first target temperature is reached and holding the metal at the first target temperature for at least two hours.

The process can include selecting a second target temperature for the metal. The second target temperate can range from about 0 degrees Fahrenheit to about 1400 degrees Fahrenheit. The process can include selecting a second temperature rate that can range from about 0.25 degrees Fahrenheit per minute to about 20 degrees Fahrenheit per minute. The second temperature rate can be controlled while heating the metal to the second target temperature. The metal temperature can be increased to the second target temperature at the second temperature rate, and then the metal cab be held at the second target temperature for at least fifteen minutes.

The process can include selecting a third target temperature for the metal, which can range from about −120 degrees Fahrenheit to about −380 degrees Fahrenheit. The process can include selecting a third temperature rate, which can range from about 0.25 degrees Fahrenheit per minute to about 20 degrees Fahrenheit per minute. The third temperature rate can be controlled while cryogenically chilling the metal by introducing a second cryogenic material into the thermal control apparatus to decrease the metal temperature, while preventing over-stressing of the metal, to the third target temperature at the third temperature rate.

The process can include inserting at least one equalizing hold time on the metal during cooling or cryogenically chilling the metal to the third target temperature. The equalizing hold time can be from about one minute to about one hundred twenty minutes. The equalizing hold time can be inserted at a second intermediate temperature for equalization of the metal temperature uniformly throughout the metal, thereby creating uniformity in the microcrystalline structure of the metal. The equalizing hold time can correspond to the size of the metal, the metal temperature, and the thermal conductivity of the metal. For example, with a third target temperature of −200 degrees Fahrenheit, an equalizing hold time can be inserted into the thermal process during the chilling of the metal to −200 degrees Fahrenheit. In this example, the second intermediate temperature can be −150 degrees Fahrenheit. The chilling of the metal can be stopped at the second intermediate temperature for a time ranging from about one minute to about one hundred twenty minutes. The chilling of the metal to the target temperature of −200 degrees Fahrenheit can then be resumed.

The process can include stopping the introduction of the second cryogenic material into the chamber once the third target temperature is reached and holding the metal at the third target temperature for at least two hours. The process can include selecting a fourth target temperature of the metal, which can ranges from about 0 degrees Fahrenheit to about 1400 degrees Fahrenheit, and selecting a fourth temperature rate, which can range from about 0.25 degrees Fahrenheit per minute to about 20 degrees Fahrenheit per minute. The fourth temperature rate can be controlled while increasing the chamber temperature to the fourth target temperature, and increasing the metal temperature to the fourth target temperature at the fourth temperature rate. The process can include holding the metal at the fourth target temperature for at least fifteen minutes, resulting in a treated metal without fractures and with an organized microcrystalline structure.

The process can include cryogenically chilling the metal by introducing a third cryogenic material into the thermal control apparatus to decrease the metal temperature, while preventing over-stressing of the metal, to a fifth target temperature at a fifth temperature rate. While cooling or cryogenically chilling the metal to the fifth target temperature, the process can include inserting at least one crystalline organizational hold time that can range from about fifteen seconds to about two hours on the metal at a third intermediate temperature. The at least one crystalline organizational hold time can be used for equalization of the metal temperature uniformly throughout the metal, creating uniformity in the microcrystalline structure of the metal. The crystalline organizational hold time can correspond to the size of the metal, the metal temperature, and the thermal conductivity of the metal. The introduction of the third cryogenic material into the chamber can be stopped once the fifth target temperature is reached. The chamber temperature can be increased to a sixth target temperature; the metal temperature can be increased to the sixth target temperature at a sixth temperature rate, resulting in the treated metal without fractures.

In one or more embodiments, the fifth temperature rate and the sixth temperature rate can be determined by the thermal conductivity of the metal; the third target temperature can be lower than the first target temperature; the fourth target temperature can be different from the second target temperature; or combinations thereof.

One or more embodiments include repeating the steps of the process at least four times.

The process can be repeated to create a second desired metallurgical feature in the treated metal without fractures. The second desired metallurgical feature can be selected from the group consisting of: malleability, flexibility, ductility, hardness, elasticity, strength, and combinations thereof.

In one or more embodiments, from about one crystalline organizational hold time to about six crystalline organizational hold times can be used; from about one stabilizing hold time to about ten stabilizing hold times can be used; from about one equalizing hold time to about eight equalizing hold times can be used; or combinations thereof.

One or more embodiments relate to a thermal process for treating a metal to improve at least one structural or metallurgical characteristic of the metal.

The process can include using a temperature control chamber that can be made from steel or other materials, can have any volume sufficient to contain the amount of metal to be treated, and can be capable of withstanding repeated applications of extreme hot and cold temperatures.

The metal that can be treated with embodiments of the process can be any metal, ferrous or non-ferrous, including but not limited to: bronze, cobalt, silver, silver alloy, nickel, nickel alloy, chromium, chromium alloy, vanadium, vanadium alloy, tungsten, tungsten alloy, titanium, titanium alloy, scandium, scandium alloy, tin, platinum, palladium, gold, gold alloy, plated metal, lead, plutonium, uranium, zinc, iron, iron alloy, magnesium, magnesium alloy, gallium, gallium arsenide, selenium, silicon, calcium, calcium fluoride, fused silica material, germanium, indium, indium phosphide, phosphorous, or combinations thereof.

The metal can also be a laminate. The laminate can be disposed on another material, such as a ceramic, a wood, a polymer, or combinations thereof. The metal can also be a Cermet™.

A cryogenic material, such as vaporous hydrogen, nitrogen, oxygen, helium, argon, or combinations thereof, can be introduced into the thermal control apparatus to decrease the metal temperature, while preventing over-stressing of the metal. The cryogenic material can be introduced through a valve, and the chamber temperature can be regulated through opening and closing the valve.

The metal temperature can be decreased to a first target temperature, which can range from about −120 degrees Fahrenheit to about −380 degrees Fahrenheit such as −300 degrees Fahrenheit.

The metal temperature can be decreased at a first temperature rate, which can range from about 0.25 degrees Fahrenheit per minute to about 20 degrees Fahrenheit per minute, such as 10 degrees per minute.

Through cryogenic treatment of the metal, all of the individual particles that make up the metal can be placed into their most stable state. These particles can then be aligned optimally with surrounding particles using the hold times. Also, molecular bonds of the metal can be strengthened by the process by having hold times with the lengths of time as related to the temperature or thermal conductivity of the metal.

The extreme cold temperatures during cryogenic processing can slow movement at the atomic level, increasing internal molecular bonding energy and promoting a pure structural balance throughout the material. The end result of the processing with hold times can be a material with an extremely uniform, refined, and dense microstructure, with vastly improved metallurgical properties.

In one or more embodiments, the thermal control apparatus can include a heat exchanger disposed in the chamber to provide a cryogenic vapor to the chamber. Each cryogenic material can be released into the heat exchanger, thereby absorbing heat from the chamber into the heat exchanger and forming a cryogenic vapor that fills the chamber. The cryogenic vapor can be hydrogen, nitrogen, oxygen, helium, argon, and combinations thereof. The cryogenic vapor can be the same for each introduction of cryogenic material, or the cryogenic vapor from the introduction of the first cryogenic material can be different than the cryogenic vapor form the introduction of the second cryogenic material.

The chamber can be: a double-walled insulated chamber, a vacuum chamber, or a vacuum-insulated chamber. The introduction of the cryogenic material into the chamber can be stopped once the first target temperature is reached, and the cryogenic temperature can be maintained for at least two hours. The holding of the metal at the first temperature for at least two hours can prevent breakage of the metal due to inadequate penetration and stress cracking. Holding the metal at the first temperature for a shorter time can increase the risk of stress cracking and cause lower performance of the metal.

The chamber temperature can then be increased to a second target temperature that can range from about 0 degrees Fahrenheit to about 1400 degrees Fahrenheit. The metal temperature can be increased to the second target temperature at a second temperature rate, which can range from about 0.25 degrees Fahrenheit per minute to about 20 degrees Fahrenheit per minute. The second target temperature can then be held for at least fifteen minutes. Holding the second target temperature for at least fifteen minutes can prevent the metal from acquiring different stresses from thermal variations across the material. This can prevent shattering of the metal. A holding time of shorter than fifteen minutes can cause uneven tempering, resulting in softening of the metal, and can create a metal with a ductile surface and with a more brittle core.

The first temperature rate and the second temperature rate can be carefully controlled to improve the characteristics of the metal. Too rapid a rate of a temperature change can result in thermal shock and micro-cracking in the metal. Larger items can require slower rates of temperature change, while smaller items can be cooled or heated more rapidly.

The steps of the process can result in a treated metal without fractures. The treated metal without fractures can possess any number of improved structural characteristics when compared to the metal that was initially placed within the thermal control apparatus. In one or more embodiments, the treated metal without fractures does not suffer from any over-stressing as a result of the thermal process, and is therefore far less likely to fracture, stress, crack, break, or deform than a metal treated by other processes.

The first temperature rate can be different from the second temperature rate, to create a first desired metallurgical feature in the treated metal without fractures. The first desired metallurgical feature can include improvements or changes in malleability, flexibility, ductility, hardness, elasticity, strength, or combinations thereof. The first temperature rate can also be substantially the same as the second temperature rate. The first temperature rate and the second temperature rate can be determined by the mass of the metal.

In one or more embodiments, the thermal process can include the steps of: introducing a cryogenic material into the thermal control apparatus to decrease the metal temperature, while preventing over-stressing of the metal, to a third target temperature at a third temperature rate. In one or more embodiments, the third target temperature is always colder than the first target temperature. The introduction of the cryogenic material into the chamber can be stopped once the third target temperature is reached. The metal temperature can be increased to a fourth target temperature at a fourth temperature rate, resulting in the treated metal without fractures. The third temperature rate and the fourth temperature rate can be determined by the mass of the metal, along with the temperature conductivity or thermal conductivity of the metal.

The thermal process can include introducing a cryogenic material into the thermal control apparatus to decrease the metal temperature, while preventing over-stressing of the metal, to a fifth target temperature at a fifth temperature rate. The introduction of the cryogenic material into the chamber can be stopped once the fifth target temperature is reached. The chamber temperature can be increased to a sixth target temperature, and the metal temperature can be increased to the sixth target temperature at a sixth temperature rate, resulting in the treated metal without fractures. The fifth temperature rate and the sixth temperature rate can be determined by the mass of the metal, along with the temperature conductivity or thermal conductivity of the metal.

In one or more embodiments, the above described steps of the thermal process can be repeated at least four times. The described steps can be repeated any number of times.

The thermal process can include the step of permitting the metal to remain at the first target temperature for a first period of time. The first period of time can range from about 15 minutes to about 96 hours.

The thermal process can include the step of permitting the metal to remain at the second target temperature for a second period of time. The second period of time can range from about 15 minutes to about 48 hours.

In one or more embodiments, the thermal process can be repeated to create a second desired metallurgical feature in the treated metal without fractures. The second desired metallurgical feature can include improvements or changes in malleability, flexibility, ductility, hardness, elasticity, strength, or combinations thereof.

The stabilizing hold times, equalizing hold times, and crystalline organizational hold times are herein collectively referred as equilibrium hold times. Illustrative examples of equilibrium hold times that can be used in the process will be described below.

For a two ounce piece of iron, steel, or steel allow, the equilibrium hold times can range from about 3-20 minutes in duration, and can be interested intermediate temperatures which can occur at specific degree intervals, such as a degree interval ranging from about 40 degrees Fahrenheit to about 300 degrees Fahrenheit. For example, if a two ounce piece of iron is being chilled from 50 degrees Fahrenheit to −200 degrees Fahrenheit, an equilibrium hold time of four minutes can be inserted during the chilling at 50 degrees intervals. In this example, an equilibrium hold time would occur at 0 degrees Fahrenheit, at −50 degrees Fahrenheit, at −100 degrees Fahrenheit, and at −150 degrees Fahrenheit, until the piece of iron reaches the desired target temperature of −200 degrees Fahrenheit. For a four pound piece of iron, steel, or steel allow, the equilibrium time can range from about ten minutes to about forty five minutes, and the specific degree intervals can range from about 25 degree intervals to about two hundred degree intervals. For a three hundred pound piece of iron, steel, or steel allow, the equilibrium time can range from about thirty minutes to about one hundred twenty minutes, and the specific degree intervals can range from about 5 degree intervals to about 100 degree intervals. For a three gram piece of copper or aluminum allow, the equilibrium hold time can be about fifteen seconds, and the specific degree interval can range from about a fifteen degree interval to about a four hundred degree interval. For a two thousand pound piece of copper or aluminum allow, the equilibrium hold time can range from about twenty minutes to about ninety minutes, and the specific degree interval can range from about a ten degree interval to about a one hundred fifty degree interval. In one or more embodiments the equilibrium hold time can be varied as the metal heats or cools towards the target temperature. In one or more embodiments the specific degree interval can be varied as the metal heats or cools towards the target temperature.

The equilibrium hold times can allow thermal equilibrium to be reached throughout the metal, thereby providing the metal with a more highly organized microcrystalline structure that is not as susceptible to fracturing.

In one or more embodiments, the thermal process can further include the step of allowing the metal to remain at the cold temperature for a period of time. The period of time can range from less than about 15 minutes to longer than about 96 hours. The aging process for an elevated temperature can be as long as four days to relieve the stress in the metal.

The temperature rates in each cycle can be determined by the mass of the metal or other properties of the metal. Basing the temperature ranges and rates on the qualities of the metal can relieve stresses, but can create new stress by super-solidification. Super-solidification is the increase in material density and organization due to the decrease of molecular movement in the material during the cryogenic treatment. One or more embodiments of the process can relieve the stresses created by the cryogenic portion of the treatment in the heat phases that follow the cooling. Through repeated chilling and heating, the molecules can be condensed into a more highly organized configuration, thereby relieving the stresses created therein.

The heat phase temperature range and rate can be determined by the qualities of the metal, such as malleability, flexibility, ductility, hardness, elasticity, strength, and combinations thereof. Repeated treatments can result in the refinement of the molecular structure for the material being treated.

One or more embodiments can include three thermal cycles of cryogenic treatment with a double heat treatment at the end of the process. The first target temperature is also referred to as a shallow chill. The third target temperature is also referred to as a cold chill. A "heat process", as the term is herein used, can include any process wherein the metal temperature is allowed to return to room temperature or anything above 0 degrees Fahrenheit. "Aging", as the term is herein used, can include holding the metal at room temperature for several days or weeks between chills. Aging can also be effective when used in combinations with embodiments of the thermal process described herein.

The following is an example of a three-wave or three cycle thermal process.

The first example can be used for enhancing the strength of steel. The steel can be first placed in the thermal control apparatus. The temperature of steel can be tempered to its appropriate temperature. The cryogenic material can be introduced into the thermal control apparatus to lower the temperature of the steel to −120 degrees Fahrenheit at a rate of 1 degree Fahrenheit per minute. This temperature rate and target temperature can increase the durability qualities of the steel. The steel can be kept at the −120 degrees Fahrenheit temperature for at least two hours. The steel can then be tempered to a second target temperature of 290 degrees Fahrenheit, and maintained at that second target temperature for at least one hour. The second cycle can begin by introducing the cryogenic material into the thermal control apparatus again. The temperature of the steel can be lowered to a third target temperature of −300 degrees Fahrenheit, and can be maintained at that third target temperature for at least twenty-four hours. The steel can then be tempered to a fourth target temperature of 290 degrees Fahrenheit, and can be maintained at that forth target temperature for at least one hour. The steel can be subjected to a third thermal cycle, wherein the temperature of the steel can be lowered to a fifth target temperature of −300 degrees Fahrenheit, and can be maintained at that fifth temperature for at least twenty-four hours. Finally, the steel can be tempered to a sixth target temperature of 290 degrees Fahrenheit, and maintained at that sixth temperature for at least one hour.

The second example is for increasing the hardness quality of steel. The steel can be placed into the thermal control apparatus and tempered to its appropriate temperature. The cryogenic material can be introduced into the thermal control apparatus to lower the temperature of the steel to −120 degrees Fahrenheit at a rate of 10 degrees Fahrenheit per minute. The rapid temperature rate can increase the hardness quality of the steel. The steel can be maintained at −120 degrees Fahrenheit for at least two hours. The steel can be tempered to a second target temperature of 290 degrees Fahrenheit, and maintained at that second target temperature for at least one hour. The steel can then be subjected to two more thermal cycles. In each cycle, the cryogenic material can be added to the thermal control apparatus, and the temperature of the steel can be lowered to a temperature of −300 degrees Fahrenheit and maintained at that temperature for at least twenty-four hours. Each cycle can end by tempering the steel to a target temperature of 290 degrees Fahrenheit and maintaining that temperature for at least one hour.

For increasing corrosion resistance in steel, the temperature can be changed according to the mass of the steel. The temperature of the steel can be lowered to −300 degrees Fahrenheit and maintained for at least twenty-four hours.

The third example is for weld enhancement, such as in 1080 wire. The wire can be tempered to 900 degrees Fahrenheit and maintained at that temperature for at least six hours to deaden the weld. The weld can then be subjected to a first thermal cycle wherein the temperature of the weld can be reduced to −120 degrees Fahrenheit and maintained for at least one hour. The weld can then be subjected to two more thermal cycles. In each cycle, the cryogenic material can be added to the thermal control apparatus and the temperature of the weld can be lowered to a temperature of −300 degrees Fahrenheit, and maintained at that temperature for at least twenty-four hours. Each cycle can end by tempering the weld to a target temperature of 290 degrees Fahrenheit and maintaining that temperature for at least one hour.

For increasing the durability of aluminum, the aluminum can be subjected to a slow temperature rate, such as 1 degree Fahrenheit per minute. The slow temperature rate can promote the increased durability in the aluminum. The temperature of the aluminum can be lowered to −120 degrees Fahrenheit and maintained at that temperature for at least two hours. The aluminum can then be tempered to 120 degrees Fahrenheit and kept at that temperature for at least two hours.

For increasing the flexibility of aluminum, also know as annealing, the aluminum can be subjected to high temperature rate, such as a rate greater than 10 degrees Fahrenheit per minute. The temperature of the aluminum can be lowered to a temperature of −300 degrees Fahrenheit and maintained at the cold temperature for at least twenty-four hours.

Turning now to the Figures, FIG. 1 provides one cycle of the steps of the process. The steps depicted in FIG. 1 can be performed at least two times consecutively.

The depicted embodiment of the process can begin by placing a metal with a metal temperature within a thermal control apparatus 110.

The thermal control apparatus can have a chamber that has a chamber temperature.

The next depicted step can include introducing a cryogenic material into the thermal control apparatus to decrease the metal temperature, without over-stressing the metal 120.

This can be followed by lowering the temperature to a first target temperature ranging from −120 degrees F. to −380 degrees F. at a first temperature rate ranging from 0.25 degrees per minute to 20 degrees per minute 130.

The process can include stopping the introduction of cryogenic material into the chamber once the first target temperature is reached 140.

The process can include increasing the chamber temperature to a second target temperature ranging from 0 degrees F. to 1400 degrees F. 150.

The process can include increasing the metal temperature at a second temperature rate ranging from 0.25 degrees per minute to 20 degrees per minute 160.

The process can include can conclude with forming a treated metal without fractures 170.

Figure 2:
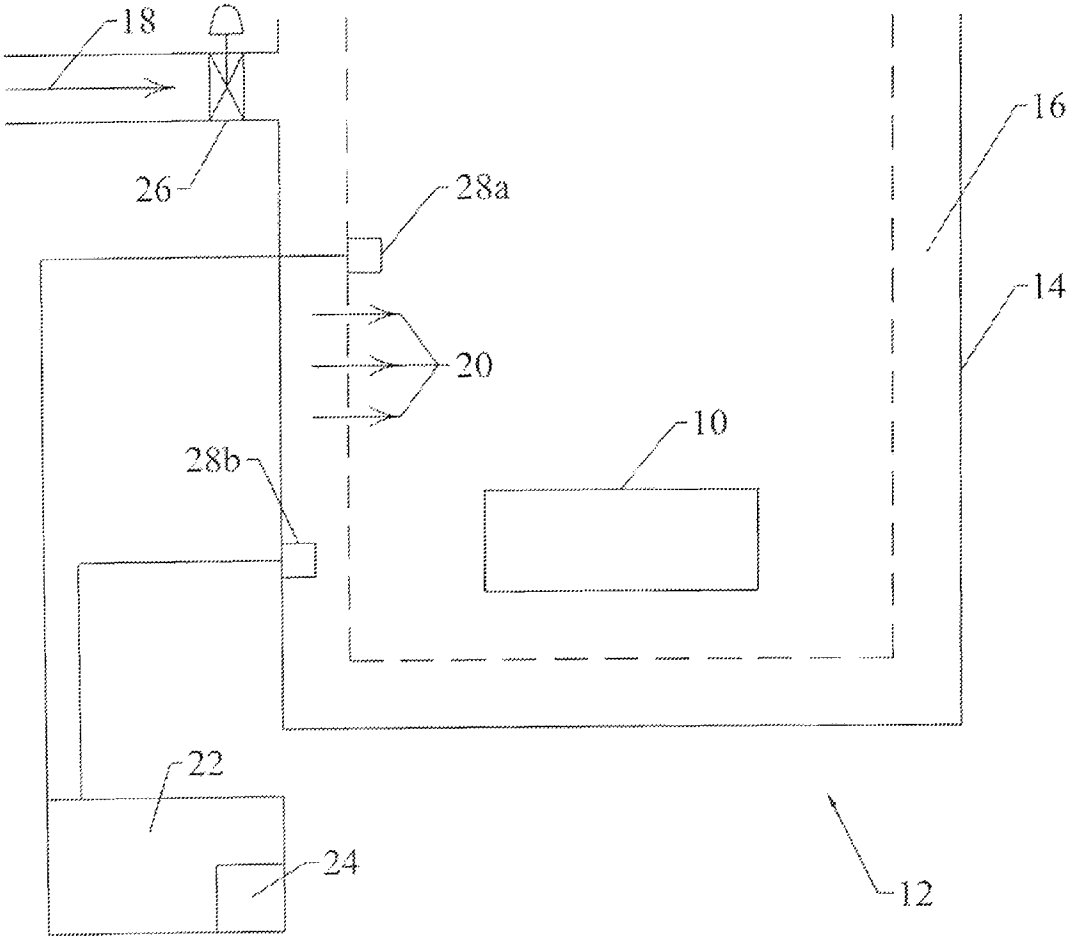
FIG. 2 depicts a detailed cross section of an embodiment of the thermal control apparatus used in the thermal process.

FIG. 2 shows a cross sectional detail of the thermal control apparatus 12 that includes a chamber 14. A cryogenic material 18 can be introduced into the thermal control apparatus 12, through a valve 26, such that the chamber temperature of the chamber 14 increases or decreases depending on whether the valve 26 is opened or closed. The chamber temperature of the chamber 14 can be closely regulated. A metal 10 can be disposed within the chamber 14 of the thermal control apparatus 12.

The cryogenic material 18 can be introduced into the thermal control apparatus 12 in order to decrease the metal temperature of the metal 10. The cryogenic material 18 can be added so that the metal 10 is not over-stressed.

Over-stressing can include fracturing the metal. The metal temperature of the metal 10 can be decreased to a first target temperature, which can range from about −120 degrees Fahrenheit to about −380 degrees Fahrenheit, at a first temperature rate, which can range from about 0.25 degrees Fahrenheit per minute to about 20 degrees Fahrenheit per minute. Once the first target temperature is reached, the cryogenic material 18 can cease to be added to the chamber 14.

The thermal control apparatus 12 can further include a heat exchanger 16 located within the chamber 14 to provide a cryogenic vapor 20 to the chamber. The cryogenic material 18 can be released into the heat exchanger 16, thereby absorbing heat from the chamber 14 into the heat exchanger 16, forming a cryogenic vapor 20 that fills the chamber 14. Examples of cryogenic vapors contemplated in this invention can be hydrogen, nitrogen, oxygen, helium, argon, and combinations thereof.

One or more embodiments can include computer control of the cryogenic process using a computer 22. The computer 22 can include a dedicated microprocessor unit 24 to control injection of the cryogenic material 18 via the valve 26. The valve 26 can be a solenoid-operated valve. Thermocouples 28*a* and 28*b* can provide real-time temperature measurement and feedback to the dedicated microprocessor unit 24, which can then follow programmed temperature targets and rates.

Using the thermal control apparatus 12, the process can include increasing the chamber temperature to a second target temperature which can range from about 0 degrees Fahrenheit to about 1400 degrees Fahrenheit. The metal temperature of the metal 10 can be increased to the second target temperature at a second temperature rate. The second temperature rate can range from about 0.25 degrees Fahrenheit per minute to about 20 degrees Fahrenheit per minute.

The process can include additional thermal cycles that can be applied to the metal 10. The cryogenic material 18 can be introduced, again, into the thermal control apparatus 12 to decrease the metal temperature of the metal 10 and to prevent over-stressing of the metal 10. The metal temperature can be decreased to a third target temperature at a third temperature rate. The third target temperature can be colder than the first target temperature.

The second cycle can continue by stopping the introduction of the cryogenic material 18 into the chamber 14 once the third target temperature is reached. The chamber temperature of the chamber 14 can then be increased to a fourth target temperature. The metal temperature of the metal 10 can be increased to the fourth target temperature at a fourth temperature rate. The second cycle can result in a treated metal without fractures with improved structural and metallurgical characteristics.

In one or more embodiments, the thermal process can include three cycles. In the third cycle, the cryogenic material 18 can be added to the thermal control apparatus 12 to decrease the metal temperature while preventing over-stressing of the metal 10. The metal temperature can be reduced to a fifth target temperature at a fifth temperature rate. When the fifth target temperature is reached, introduction of the cryogenic material 18 into the chamber 14 can be ceased.

The third cycle can continue by increasing the chamber temperature to a sixth target temperature, thereby increasing the metal temperature to the sixth target temperature. The metal temperature can be increased at a sixth temperature rate, resulting in a treated metal without fractures with improved structural and metallurgical characteristics.

Figure 3A:
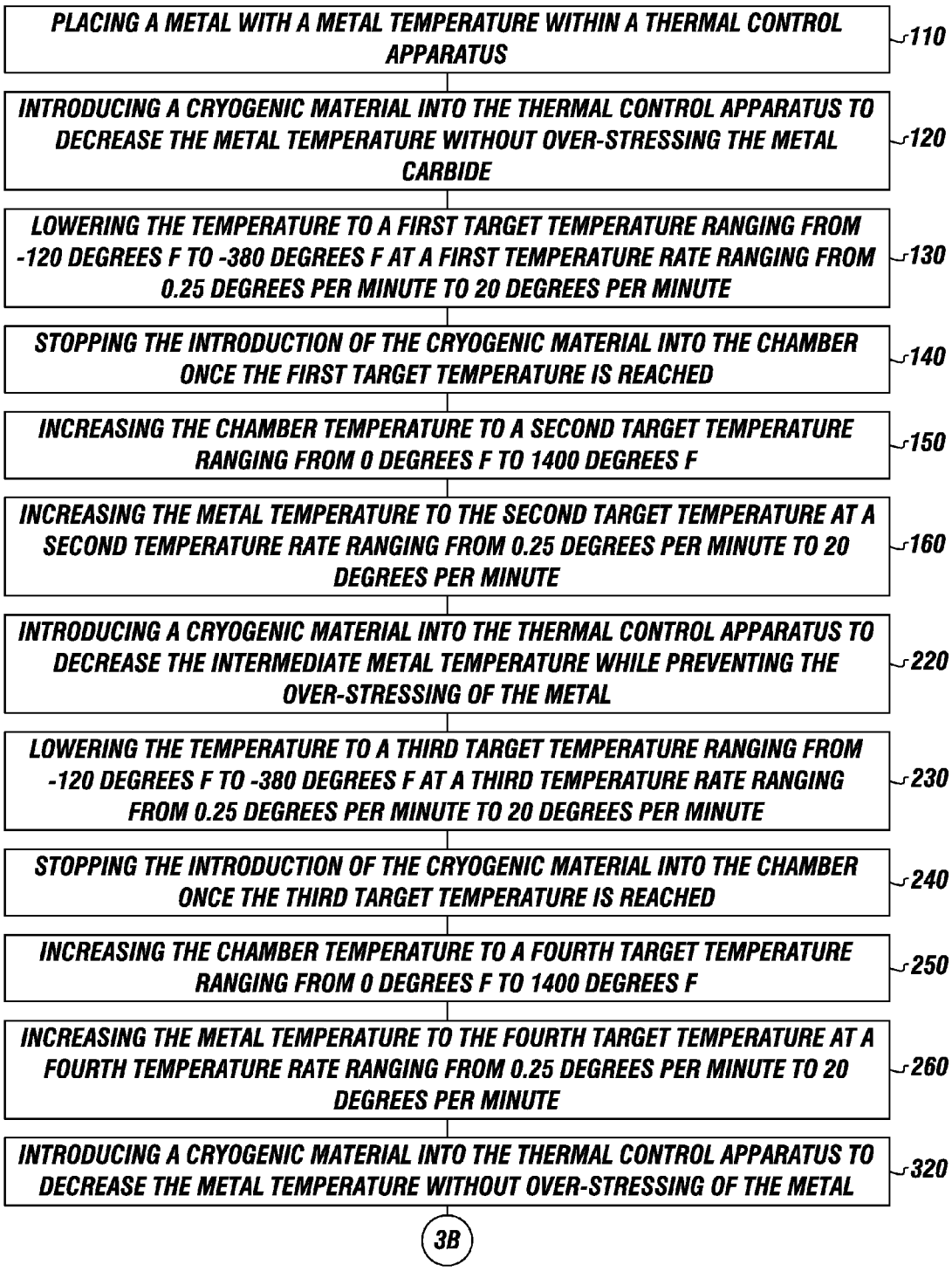
FIGS. 3A-3B is a schematic diagram that shows a portion of three thermal cycles of the method shown in FIG. 1.

FIG. 3A depicts an embodiment of the thermal process wherein the thermal process includes three thermal cycles resulting in a treated metal without fractures and improved structural and metallurgical characteristics.

The process can include placing a metal with a metal temperature within a thermal control apparatus 110.

The process can include introducing a cryogenic material into the thermal control apparatus to decrease the metal temperature without over-stressing the metal 120.

The process can include lowering the temperature to a first target temperature ranging from −120 degrees F. to −380 degrees F. at a first temperature rate ranging from 0.25 degrees per minute to 20 degrees per minute 130.

The process can include stopping the introduction of the cryogenic material into the chamber once the first target temperature is reached 140.

The process can include increasing the chamber temperature is increased to a second target temperature ranging from 0 degrees to 1400 degrees F. 150.

The process can include increasing the metal temperature to the second target temperature at a second temperature rate ranging from 0.25 degrees per minute to 20 degrees per minute 160.

The process can include introducing a cryogenic material into the thermal control apparatus to decrease the intermediate metal temperature while preventing the over-stressing of the metal 220.

The process can include lowering the temperature to a third target temperature ranging from −120 degrees F. to −380 degrees F. at a third temperature rate ranging from 0.25 degrees per minute to 20 degrees per minute 230.

The process can include stopping the introduction of the cryogenic material into the chamber once the third target temperature is reached 240.

The process can include increasing the chamber temperature to a fourth target temperature ranging from 0 degrees to 1400 degrees F. 250.

The process can include increasing the metal temperature to the fourth target temperature at a fourth temperature rate ranging from 0.25 degrees per minute to 20 degrees per minute 260.

The process can include introducing a cryogenic material into the thermal control apparatus to decrease the metal temperature without over-stressing the metal 320.

Figure 3B:
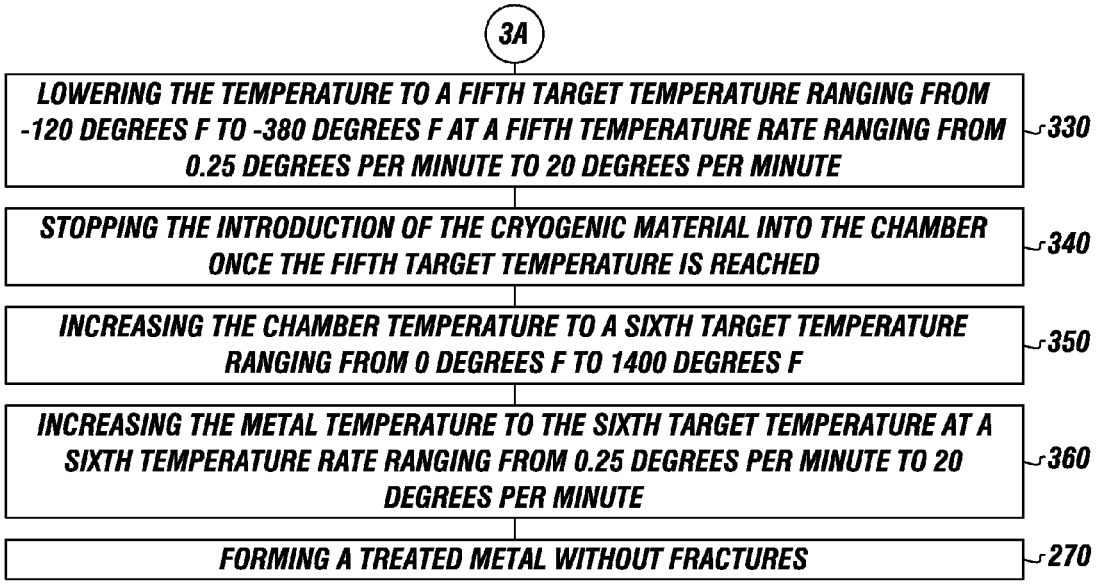

FIG. 3B is a continuation of FIG. 3A. The process can include lowering the temperature to a fifth target temperature ranging from −120 degrees F. to −380 degrees F. at a fifth temperature rate ranging from 0.25 degrees per minute to 20 degrees per minute 330.

The process can include stopping the introduction of the cryogenic material into the chamber once the fifth target temperature is reached 340.

The process can include increasing the chamber temperature to a sixth target temperature ranging from 0 degrees to 1400 degrees F. 350.

The process can include increasing the metal temperature is increased to the sixth target temperature at a sixth fourth temperature rate ranging from 0.25 degrees per minute to 20 degrees per minute 360.

The process can include forming a treated metal without fractures 270.

Figure 4A:
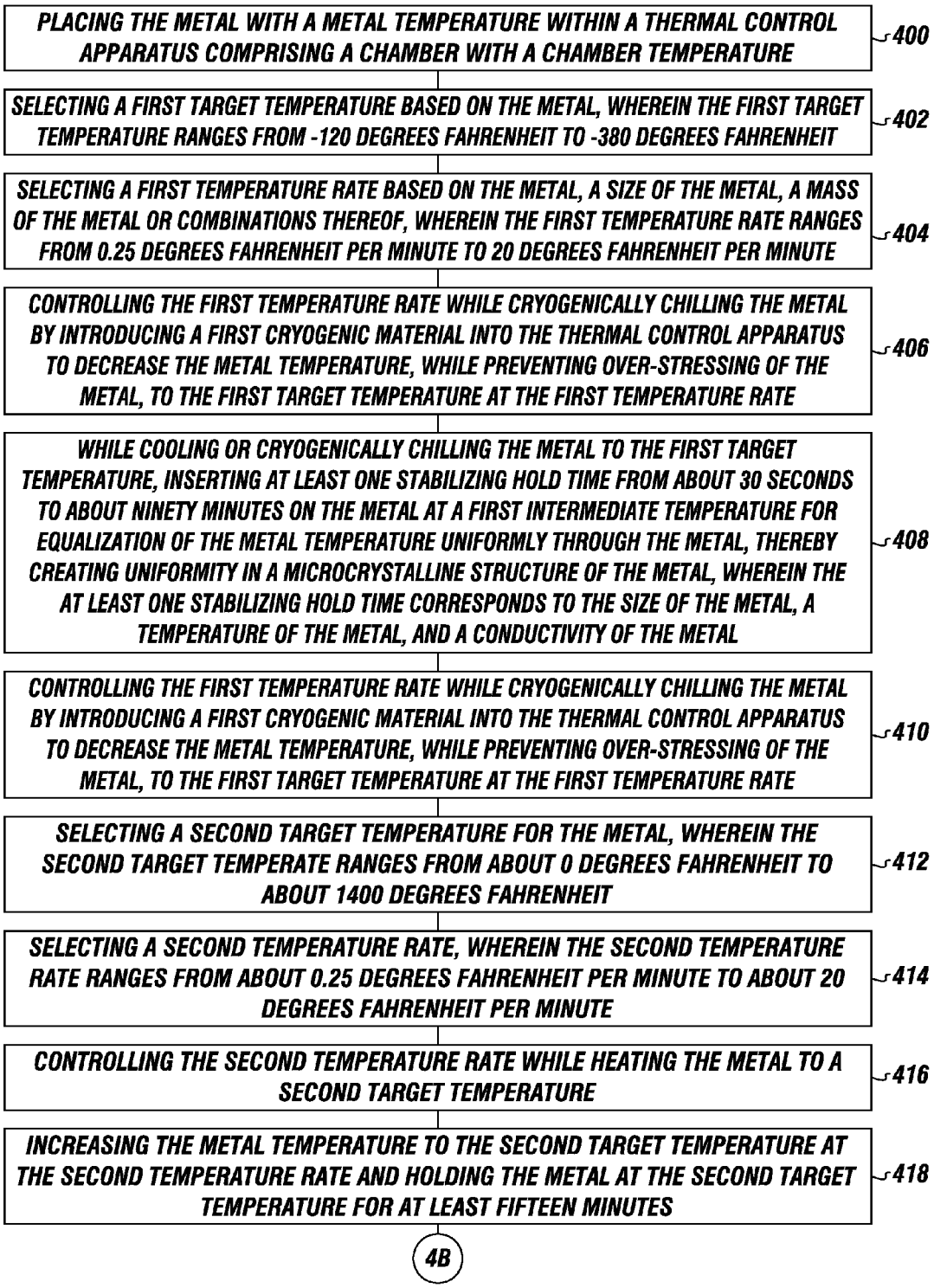
FIGS. 4A-4C is a flow chart of an embodiment of the process.

FIG. 4A depicts an embodiment of a multi-wave thermal process for treating a metal to improve at least one structural characteristic of the metal.

The process can include placing the metal with a metal temperature within a thermal control apparatus comprising a chamber with a chamber temperature, as illustrated by box 400.

The process can include selecting a first target temperature based on the metal, wherein the first target temperature ranges from −120 degrees Fahrenheit to −380 degrees Fahrenheit, as illustrated by box 402.

The process can include selecting a first temperature rate based on the metal, a size of the metal, a mass of the metal or combinations thereof, wherein the first temperature rate ranges from 0.25 degrees Fahrenheit per minute to 20 degrees Fahrenheit per minute, as illustrated by box 404.

The process can include controlling the first temperature rate while cryogenically chilling the metal by introducing a first cryogenic material into the thermal control apparatus to decrease the metal temperature, while preventing over-stressing of the metal, to the first target temperature at the first temperature rate, as illustrated by box 406.

The process can include, while cooling or cryogenically chilling the metal to the first target temperature, inserting at least one stabilizing hold time from about 30 seconds to about ninety minutes on the metal at a first intermediate temperature for equalization of the metal temperature uniformly through the metal, thereby creating uniformity in a microcrystalline structure of the metal, wherein the at least one stabilizing hold time corresponds to the size of the metal, a temperature of the metal, and a conductivity of the metal, as illustrated by box 408.

The process can include stopping the introduction of the first cryogenic material into the chamber once the first target temperature is reached and holding the metal at the first target temperature for at least two hours, as illustrated by box 410.

The process can include selecting a second target temperature for the metal, wherein the second target temperate ranges from about 0 degrees Fahrenheit to about 1400 degrees Fahrenheit, as illustrated by box 412.

The process can include selecting a second temperature rate, wherein the second temperature rate ranges from about 0.25 degrees Fahrenheit per minute to about 20 degrees Fahrenheit per minute, as illustrated by box 414.

The process can include controlling the second temperature rate while heating the metal to a second target temperature, as illustrated by box 416.

The process can include increasing the metal temperature to the second target temperature at the second temperature rate and holding the metal at the second target temperature for at least fifteen minutes, as illustrated by box 418.

Figure 4B:
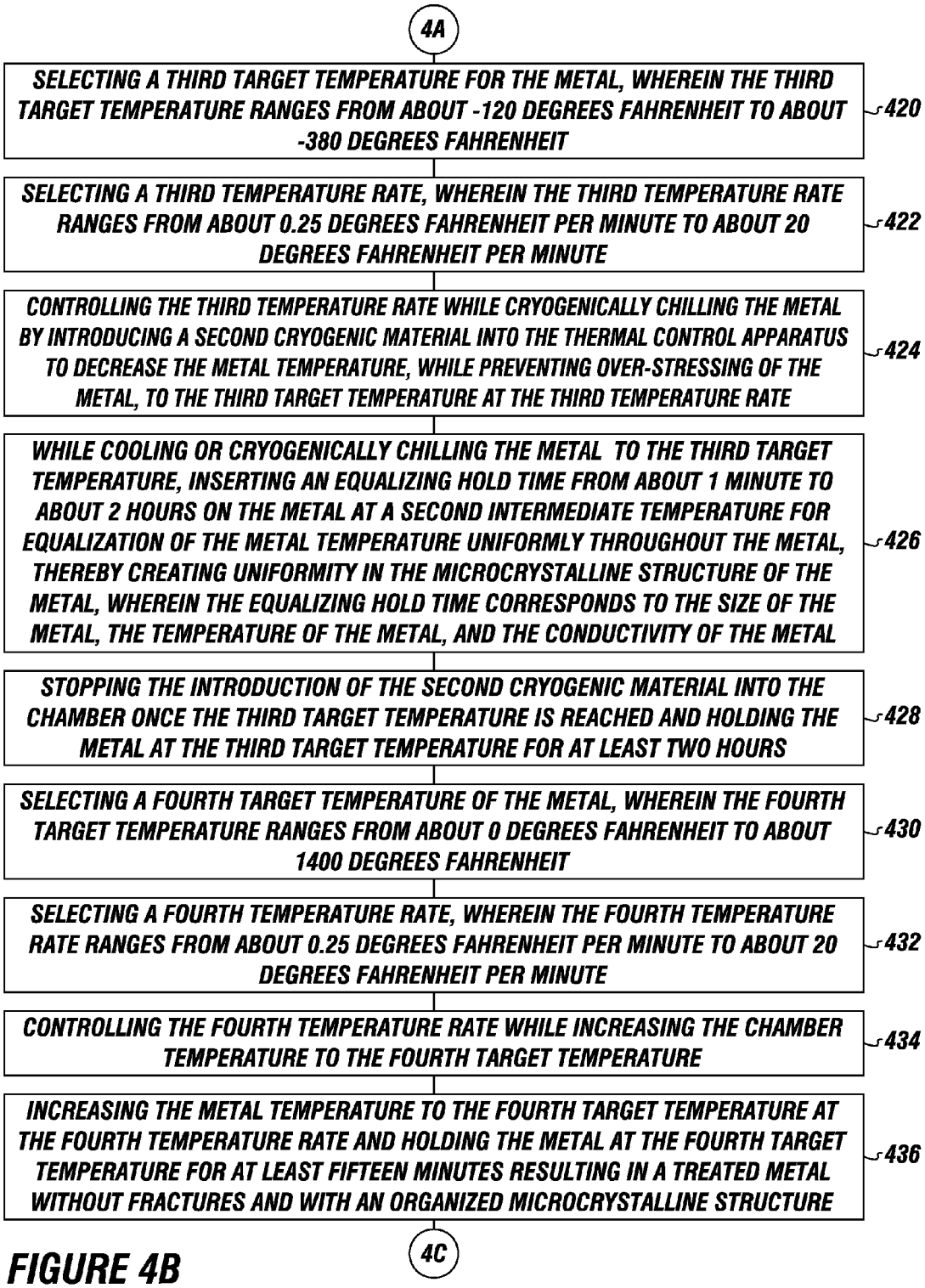

FIG. 4B is a continuation of FIG. 4A. The process can include selecting a third target temperature for the metal, wherein the third target temperature ranges from about −120 degrees Fahrenheit to about −380 degrees Fahrenheit, as illustrated by box 420.

The process can include selecting a third temperature rate, wherein the third temperature rate ranges from about 0.25 degrees Fahrenheit per minute to about 20 degrees Fahrenheit per minute, as illustrated by box 422.

The process can include controlling the third temperature rate while cryogenically chilling the metal by introducing a second cryogenic material into the thermal control apparatus to decrease the metal temperature, while preventing over-stressing of the metal, to the third target temperature at the third temperature rate, as illustrated by box 424.

The process can include, while cooling or cryogenically chilling the metal to the third target temperature, inserting an equalizing hold time from about 1 minute to about 2 hours on the metal at a second intermediate temperature for equalization of the metal temperature uniformly throughout the metal, thereby creating uniformity in the microcrystalline structure of the metal, wherein the equalizing hold time corresponds to the size of the metal, the temperature of the metal, and the conductivity of the metal, as illustrated by box 426.

The process can include stopping the introduction of the second cryogenic material into the chamber once the third target temperature is reached and holding the metal at the third target temperature for at least two hours, as illustrated by box 428.

The process can include selecting a fourth target temperature of the metal, wherein the fourth target temperature ranges from about 0 degrees Fahrenheit to about 1400 degrees Fahrenheit, as illustrated by box 430.

The process can include selecting a fourth temperature rate, wherein the fourth temperature rate ranges from about 0.25 degrees Fahrenheit per minute to about 20 degrees Fahrenheit per minute, as illustrated by box 432.

The process can include controlling the fourth temperature rate while increasing the chamber temperature to the fourth target temperature, as illustrated by box 434.

The process can include increasing the metal temperature to the fourth target temperature at the fourth temperature rate and holding the metal at the fourth target temperature for at least fifteen minutes resulting in a treated metal without fractures and with an organized microcrystalline structure, as illustrated by box 436.

Figure 4C:
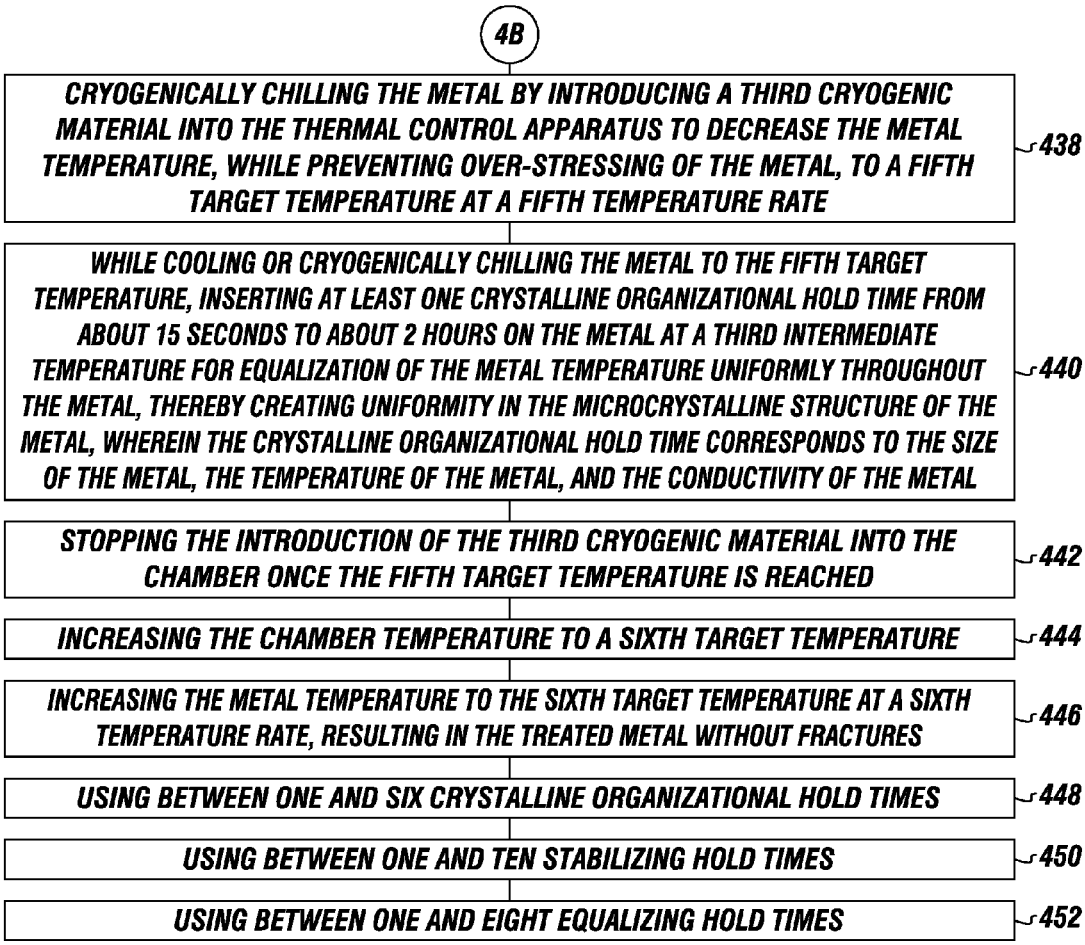

FIG. 4C is a continuation of FIG. 4B. The process can include cryogenically chilling the metal by introducing a third cryogenic material into the thermal control apparatus to decrease the metal temperature, while preventing over-stressing of the metal, to a fifth target temperature at a fifth temperature rate, as illustrated by box 438.

The process can include, while cooling or cryogenically chilling the metal to the fifth target temperature, inserting at least one crystalline organizational hold time from about 15 seconds to about 2 hours on the metal at a third intermediate temperature for equalization of the metal temperature uniformly throughout the metal, thereby creating uniformity in the microcrystalline structure of the metal, wherein the crystalline organizational hold time corresponds to the size of the metal, the temperature of the metal, and the conductivity of the metal, as illustrated by box 440.

The process can include stopping the introduction of the third cryogenic material into the chamber once the fifth target temperature is reached, as illustrated by box 442.

The process can include increasing the chamber temperature to a sixth target temperature, as illustrated by box 444.

The process can include increasing the metal temperature to the sixth target temperature at a sixth temperature rate, resulting in the treated metal without fractures, as illustrated by box 446.

The process can include using between one and six crystalline organizational hold times, as illustrated by box 448.

The process can include using between one and ten stabilizing hold times, as illustrated by box 450.

The process can include using between one and eight equalizing hold times, as illustrated by box 452.

While these embodiments have been described with emphasis on the preferred embodiments, it should be understood that within the scope of the appended claims the embodiments might be practiced other than as specifically described herein.

What is claimed is:

1. A multi-wave thermal process for treating a metal to improve at least one structural characteristic of the metal, the thermal process comprising:

a. placing the metal with a metal temperature within a thermal control apparatus comprising a chamber with a chamber temperature;

b. selecting a first target temperature based on the metal, wherein the first target temperature ranges from −120 degrees Fahrenheit to −380 degrees Fahrenheit;

c. selecting a first temperature rate based on the metal, a size of the metal, a mass of the metal or combinations thereof, wherein the first temperature rate ranges from 0.25 degrees Fahrenheit per minute to 20 degrees Fahrenheit per minute;

d. controlling the first temperature rate while cryogenically chilling the metal by introducing a first cryogenic material into the thermal control apparatus to decrease the metal temperature, while preventing over-stressing of the metal, to the first target temperature at the first temperature rate, and while cryogenically chilling the metal to the first target temperature, inserting at least one stabilizing hold time from 30 seconds to 90 minutes on the metal at an first intermediate temperature for equalization of the metal temperature uniformly throughout the metal, thereby creating uniformity in a microcrystalline structure of the metal, wherein the at least one stabilizing hold time corresponds to the size of the metal, the metal temperature, a thermal conductivity of the metal, or combinations thereof;

e. stopping the introduction of the first cryogenic material into the chamber once the first target temperature is reached and holding the metal at the first target temperature for at least two hours;

f. selecting a second target temperature for the metal, wherein the second target temperate ranges from 0 degrees Fahrenheit to 1400 degrees Fahrenheit;

g. selecting a second temperature rate, wherein the second temperature rate ranges from 0.25 degrees Fahrenheit per minute to 20 degrees Fahrenheit per minute;

h. controlling the second temperature rate while heating the metal to the second target temperature;

i. increasing the metal temperature to the second target temperature at the second temperature rate and holding the metal at the second target temperature for at least fifteen minutes;

j. selecting a third target temperature for the metal, wherein the third target temperature ranges from −120 degrees Fahrenheit to −380 degrees Fahrenheit;

k. selecting a third temperature rate, wherein the third temperature rate ranges from 0.25 degrees Fahrenheit per minute to 20 degrees Fahrenheit per minute;

l. controlling the third temperature rate while cryogenically chilling the metal by introducing a second cryogenic material into the thermal control apparatus to decrease the metal temperature, while preventing over-stressing of the metal, to the third target temperature at the third temperature rate, and while cryogenically chilling the metal to the third target temperature, inserting at least one equalizing hold time from 1 minute to 2 hours on the metal at a second intermediate temperature for equalization of the metal temperature uniformly throughout the metal, thereby creating uniformity in the microcrystalline structure of the metal, wherein the at least one equalizing hold time corresponds to the size of the metal, the metal temperature, the thermal conductivity of the metal, or combinations thereof;

m. stopping the introduction of the second cryogenic material into the chamber once the third target temperature is reached and holding the metal at the third target temperature for at least two hours;

n. selecting a fourth target temperature for the metal, wherein the fourth target temperature ranges from 0 degrees Fahrenheit to 1400 degrees Fahrenheit;

o. selecting a fourth temperature rate, wherein the fourth temperature rate ranges from 0.25 degrees Fahrenheit per minute to 20 degrees Fahrenheit per minute;

p. controlling the fourth temperature rate while increasing the chamber temperature to the fourth target temperature; and q. increasing the metal temperature to the fourth target temperature at the fourth temperature rate and holding the metal at the fourth target temperature for at least fifteen minutes, resulting in a treated metal without fractures and with an organized microcrystalline structure.

2. The thermal process of claim 1, wherein the first temperature rate is different from the second temperature rate to create a first desired metallurgical feature in the treated metal, and wherein the first desired metallurgical feature is selected from the group consisting of: malleability, flexibility, ductility, hardness, elasticity, strength, and combinations thereof.

3. The thermal process of claim 1, wherein the first temperature rate is substantially the same as the second temperature rate.

4. The thermal process of claim 1, further comprising the steps of:

r. cryogenically chilling the metal by introducing a third cryogenic material into the thermal control apparatus to decrease the metal temperature, while preventing overstressing of the metal, to a fifth target temperature at a fifth temperature rate, and while cryogenically chilling the metal to the fifth target temperature, inserting at least one crystalline organizational hold time from 15 seconds to 2 hours on the metal at a third intermediate temperature for equalization of the metal temperature uniformly throughout the metal, thereby creating uniformity in the microcrystalline structure of the metal, wherein the at least one crystalline organizational hold time corresponds to the size of the metal, the metal temperature, the thermal conductivity of the metal, or combinations thereof;

s. stopping the introduction of the third cryogenic material into the chamber once the fifth target temperature is reached;

t. increasing the chamber temperature to a sixth target temperature; and u. increasing the metal temperature to the sixth target temperature at a sixth temperature rate, resulting in the treated metal without fractures.

5. The thermal process of claim 4, wherein the fifth temperature rate and the sixth temperature rate are determined by the thermal conductivity of the metal.

6. The thermal process of claim 4, further comprising repeating the steps of the process at least four times.

7. The thermal process of claim 4, further comprising using from one crystalline organizational hold time to six crystalline organizational hold times.

8. The thermal process of claim 1, further comprising holding the metal at the first target temperature for a time ranging from two hours to 96 hours.

9. The thermal process of claim 1, further comprising holding the metal at the second target temperature for a time ranging from fifteen minutes to 48 hours.

10. The thermal process of claim 1, further comprising repeating the thermal process to create a second desired metallurgical feature in the treated metal, wherein the second desired metallurgical feature is selected from the group consisting of: malleability, flexibility, ductility, hardness, elasticity, strength, and combinations thereof.

11. The thermal process of claim 1, wherein the thermal control apparatus further comprises a heat exchanger disposed in the chamber to provide a cryogenic vapor to the chamber.

12. The thermal process of claim 11, wherein the first cryogenic material and the second cryogenic material are both released into the heat exchanger, thereby absorbing heat from the chamber into the heat exchanger and forming a cryogenic vapor that fills the chamber.

13. The thermal process of claim 12, wherein the cryogenic vapor is a member of the group consisting of: hydrogen, nitrogen, oxygen, helium, argon, and combinations thereof.

14. The thermal process of the claim 1, wherein the chamber is selected from the group consisting of: a double-walled insulated chamber, a vacuum chamber, and a vacuum-insulated chamber.

15. The thermal process of claim 1, wherein the third target temperature is lower than the first target temperature.

16. The thermal process of claim 1, wherein the fourth target temperature is different from the second target temperature.

17. The thermal process of claim 1, further comprising using from one stabilizing hold time to ten stabilizing hold times.

18. The thermal process of claim 1, further comprising using from one equalizing hold time to eight equalizing hold times.

* * * * *